United States Patent [19]

Arens et al.

[11] Patent Number: 4,573,491

[45] Date of Patent: Mar. 4, 1986

[54] TUBE SEPARATOR

[75] Inventors: Hans Arens, Wertingen; Hans Kern, Vachendorf; Richard Haslberger, Hufschlag, all of Fed. Rep. of Germany

[73] Assignee: Grunbeck Wasseraufbereitung GmbH, Hochstadt, Fed. Rep. of Germany

[21] Appl. No.: 640,765

[22] PCT Filed: Dec. 15, 1983

[86] PCT No.: PCT/EP83/00338

§ 371 Date: Aug. 14, 1984

§ 102(e) Date: Aug. 14, 1984

[87] PCT Pub. No.: WO84/02544

PCT Pub. Date: Jul. 5, 1984

[30] Foreign Application Priority Data

Dec. 21, 1982 [DE] Fed. Rep. of Germany ..... 3247325

[51] Int. Cl.[4] ..... E03C 1/10

[52] U.S. Cl. ..... 137/218; 137/107; 137/486

[58] Field of Search ..... 137/107, 218, 486

[56] References Cited

U.S. PATENT DOCUMENTS 2,588,284 3/1952 Otis .

4,249,556 2/1981 Waletzko ..... 137/218 X

FOREIGN PATENT DOCUMENTS 2849825 5/1980 Fed. Rep. of Germany .

*Primary Examiner*—Gerald A. Michalsky

*Attorney, Agent, or Firm*—Donald Brown

[57] ABSTRACT

A tube separator (1) is provided comprising a shut-off means (4) for separating an inlet side (2) from an outlet side (3) as well as a control valve (11) controlling the shut-off means (4) in dependence on the difference of the pressure at the inlet side 2 and the outlet side 3. In order to prevent a flutter of the shut-off means (4) for low flow rates a valve (42) is provided which is designed such that it releases the connection of the outlet pressure with the control valve (11) only if the flow rate of the medium drops below a certain value.

11 Claims, 3 Drawing Figures

TUBE SEPARATOR

The invention refers to a tube separator or backflow preventing device, respectively, according to the preamble of claim 1.

A tube separator of this kind is known from the DE-OS 2747941. This known apparatus uses a differential pressure measuring device, the one side thereof being permanently acted upon by the inlet pressure and the other side thereof being permanently acted upon by the outlet pressure of the tube separator. Hence, if the medium flow rate through the tube separator and thus the pressure difference between the inlet and outlet pressure drops below a certain value, it may be caused that the tube separator will shut off and will instantaneously open again due to the increasing pressure difference resulting from the shut-off.

It is the object of the invention to provide an improved tube separator. In particular change-over oscillations shall be avoided, particularly for low flow rates.

This object is achieved by a tube separator of the above mentioned kind, which according to the invention is characterized by the features of claim 1.

Further advantages of the invention are characterized in the sub-claims.

Further features and advantages of the invention will stand out from the description of an embodiment in connection with the Figures. In the Figures.

Figure 1:
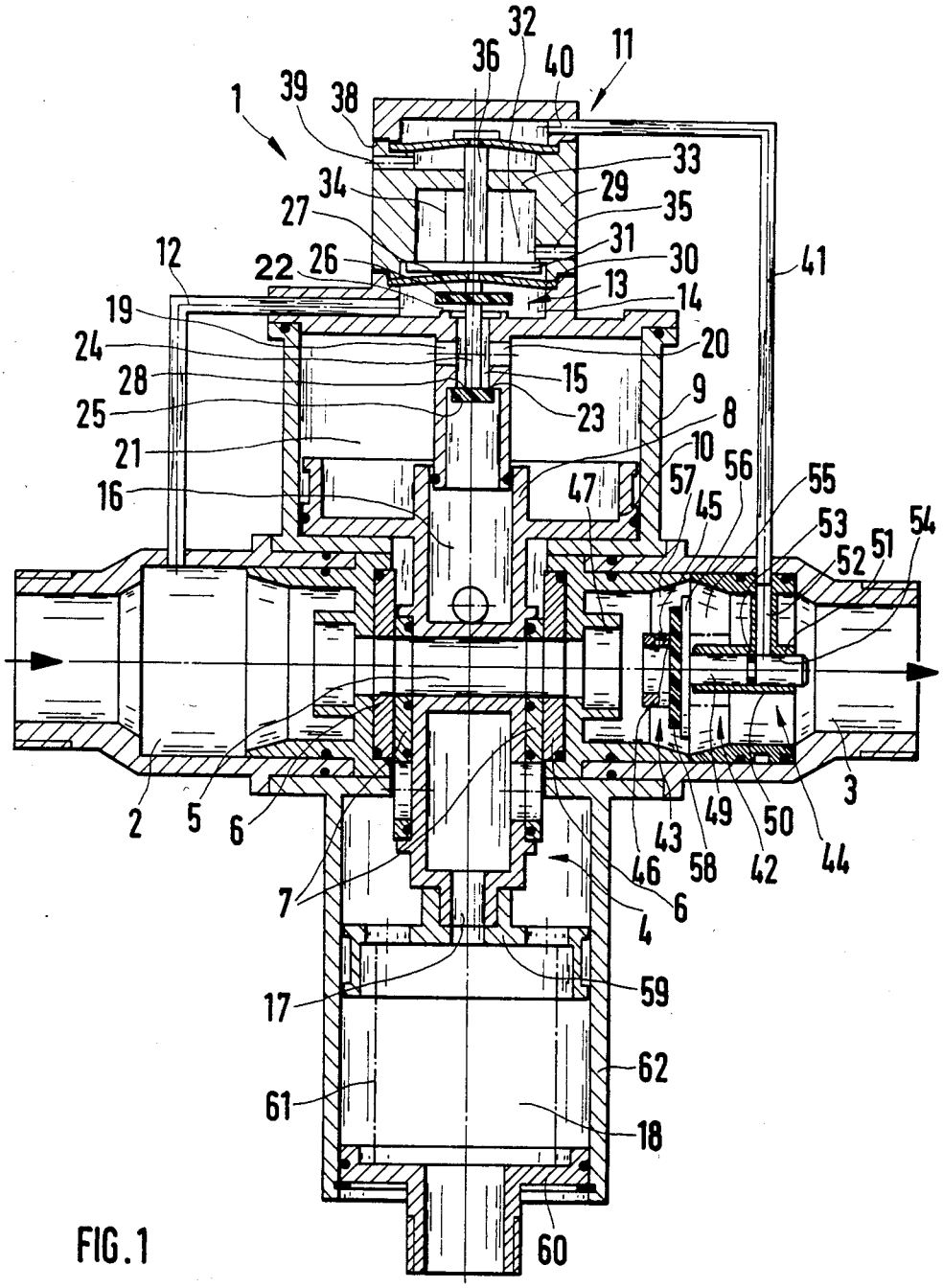
FIG. 1 is a sectional view of a tube separator with shut-off means, control valve and valve in their respective first position.

The tube separator or backflow preventor 1, respectively, comprises an inlet 2 and an outlet 3, the inlet and outlet being each connectable with a respective tube. A slide valve 4 having a connecting channel 5 which may be connected with the inlet 2 and the outlet 3, is provided between the inlet 2 and the outlet 3. The slide valve and the connecting channel are designed such that the inlet 2 and the outlet 3 are connected with each other in the first position shown in FIG. 1 and separated from each other in the second position of the slide valve 4, in which the same is displaced transversely to the connection line of inlet 2 and outlet 3. Suitable gaskets formed as cooperating flat slide valve gaskets 6, 7 with respective ring gaskets are provided for sealing between inlets 2 and slide valve 4 and slide valve 4 and outlet 3, respectively. The flat slide valve gaskets 6, 7 are designed as ceramic plates or ceramic washers, respectively.

One end 8 of the slide valve 4 extends into a cylinder 9 in which the slide valve 4 may reciprocally slide as a piston 10 in dependence on the pressure prevailing within the cylinder.

The interior of the cylinder 9 is connectable with the inlet 2 via a control valve 11 and a connecting conduit 12. The control valve 11 comprises a valve chamber 13 having a first section 14 and a second section 15. The inlet of the first section is connected with the connecting conduit 12 forming the first inlet of the control valve 11, and the outlet of the first section is connected with the second section 15. The second section is formed as a bore having the end thereof turned away from the first section opening into a bore 16 of the slide valve 4. The bore 16 leads into the environment or into a space 18 in which the environmental pressure or at least a pressure prevails which is below the pressure prevailing at inlet 2 when the flow medium acts thereon, via an exit bore 17.

Furthermore, the second section 15 is connected with the interior 21 of the cylinder 9 via cross-bores 19, 20. The second section 15 comprises valve seats 22, 23 at the end thereof facing the first section as well as at the end thereof facing the bore 16. A valve rod 24 is provided which passes through the second section 15 and which comprises the valve body 25 at the end thereof turned away from the first section and a second valve body 26 in a distance from the valve body 25 which is larger than the distance between both valve seats 22, 23. As may be seen from FIG. 1 the surface area 27 of the second valve body 26 facing the first section 14 is larger than the area 28 of the first valve body 25 which may be acted upon via the second section 15.

The wall of the first section 14 opposing the second section 15 is formed by a diaphragm 30 having the edge thereof firmly clamped by a control valve housing 29. As may be seen from FIG. 1 the valve rod 24 is prolonged through the first section 14 to such an extent that, passing through the diaphragm 30, it is firmly connected with an abutment plate 31 and the diaphragm 30 itself. The control valve housing forms a chamber 32 which is defined by an abutment 33 on the side turned away from the diaphragm 30, on the side of the diaphragm 30 turned away from the valve chamber 13. A compression spring 34 urging the diaphragm 30 and hence the valve bodies 25, 26 into the second position via the abutment plate 31 is disposed between the abutment 33 and the abutment plate 31. The chamber 32 is connected with the environment via a bore 35 through the control valve housing. By means of a connecting rod 36 the abutment plate 31 is firmly connected with a second pressure measuring means formed by a second diaphragm 38 which has the edges thereof firmly clamped and which is disposed coaxially with the diaphragm 30. The side of the diaphragm 38 facing the diaphragm 30 is connected with the environment via a bore 39, whereas the side of the diaphragm 38 turned away from the diaphragm 30 may be acted upon by the outlet pressure of the tube separator 1 via a bore 40 forming the second inlet of the control valve 11 and a following connecting conduit 41. This pressure results in an initial stress or prestressing of the control valve 11 in direction to the second position thereof, in the same direction or sense as that caused by the force of spring 34.

Figure 2:
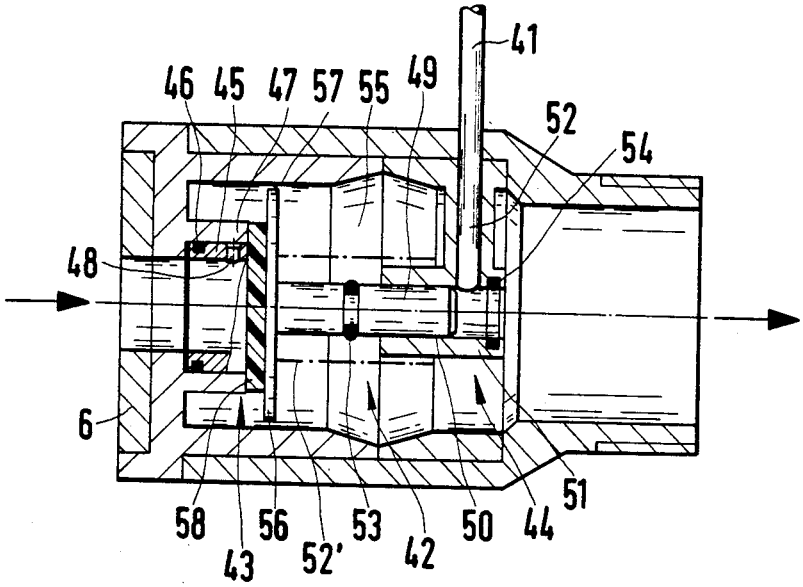
FIG. 2 is an enlarged sectional view of the valve in the second position.

A valve 42 for controlling the pressure within the connecting conduit 41 is disposed at the outlet side 3. This valve is represented in detail in the FIGS. 2 and 3. If the flow rate from inlet 2 to outlet 3 drops below a determined value, the valve 42 serves to first connect the connecting conduit 41 with the outlet 3 such that the outlet pressure acts upon the second inlet 40 of the control valve 11, and thereupon to seal off the outlet side towards the slide valve 4. To this end the valve 42 comprises a first shut-off valve 43 for closing the connection of channel 5 towards the outlet side and a second shut-off valve 44 for opening and closing the connection of the connecting conduit 41 with the outlet side, the second shut-valve 44 being connected with the first shut-off valve 43. The first shut-off valve 43 comprises a valve body 45 formed as a hollow cylinder having one end surface thereof closed and which has a circumferential gasket 46 at the outside thereof and cooperates with a valve seat 47. The valve seat 47 is disposed at the upstream side of outlet 3 and is as well formed as a hollow cylinder having an inner diameter selected such that the valve body 45 may freely be moved into the valve seat 47 and may be sealed therein by means of the circumferential gasket 46.

The valve body 45 has a radial bore 48 between the circumferential gasket 46 and the closed end plane. A valve rod 49 which is slidable supported in a guide bore 50 disposed in a support 51 in flow direction, is mounted to the valve body 45 at the side thereof turned away from the valve seat 47. The valve body 45 is urged towards the valve seat 47 by means of a spring 52'.

Figure 3:
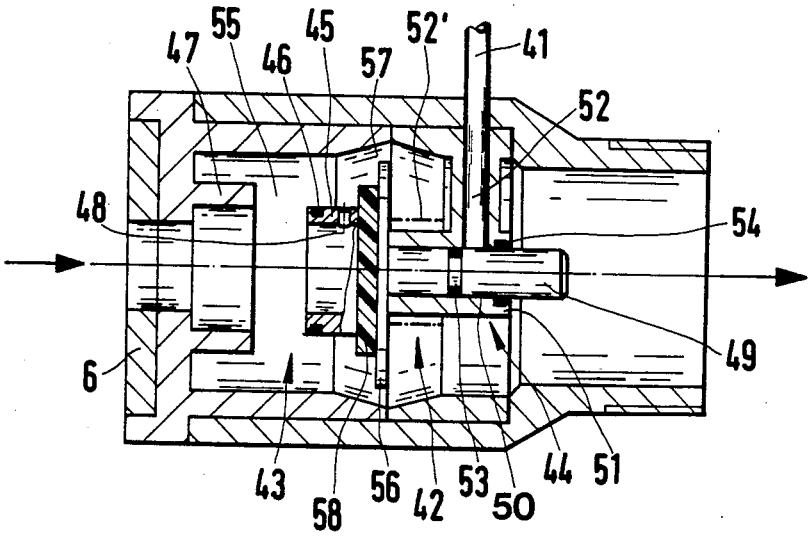
FIG. 3 is a sectional view of the valve in the first position.

The second shut-off valve is formed by the cooperation of the valve rod 49 with a cross bore 52 forming the end of the conduit 41 adjacent to the valve 42. The cross bore 52 forms a connection of the guide bore 50 with the connecting conduit 41 and opens into the guide bore 50 close to that end of the guide bore 50 which is turned away from the valve seat 47. At this end the guide bore opens towards the outlet side. The length of the valve rod 49 is selected such that the valve rod 49 just no longer covers the cross bore 52, if the valve body 45 is moved all the way into the valve seat 47, and hence releases the connection of cross bore 52 with the outlet side via the free end of channel 50. This position shown in FIG. 2 defines the first end position of the valve 42. The second end position shown in FIG. 3 is defined such that the valve body 45 is moved out of the valve seat 47 and valve rod 49 closes the cross bore 52. The mutual sealing is obtained by a circumferential seal 53 on the valve rod 49 as well as a circumferential seal 54 around the guide bore 50 between the cross bore 52 and the free end of the guide bore 50.

The two valves 43, 44 are designed in relation to each other such that there is a positive overlap at the state where the valve 43 is still in engagement with, but right before disengagement of the circumferential gasket 46 thereof from the cylinder 47 before emerging therefrom. In this position the valve 44 is already closed by engagement of the valve rod 49 with the seal 54 and thereby closing the opening towards the connecting conduit 41.

The valve 42 together with the support 51 thereof is disposed in a flow channel 55 and comprises a baffle plate 56 between the valve body 45 and the valve rod 49, the outer diameter of the baffle plate being slightly smaller than the inner diameter of the channel 55 such that a gap 57 is formed between the baffle plate 56 and the inner wall of the channel. The channel 55 is widened from a location where the baffle plate 56 is positioned in the mentioned intermediate position of the valve 42, towards a location where the baffle plate 56 is positioned when the valve 42 is in its second position, such that the gap 57 is enlarged in the second position of the valve 42. A flat gasket 58 abutting against the front side of the valve seat 47 in the first position of the valve 42 and hence causing a complete closing of the first shut-off valve 43 is provided between the baffle plate 56 and the valve body 45 for complete sealing.

The baffle plate has an effective cross-section which corresponds to about the twofold to threefold of the effective cross-section of the valve 43 in the closed first end position. It is thus achieved that after emerging of the gasket 46 from the cylinder 47 a substantially smaller pressure is required for overcoming the urging force of the spring 52' and hence the pressure drop is substantially lower.

The slide valve 4 has an abutment plate 59 at the lower end thereof turned away from the piston 10. A compression spring 61 abutting against a fixed plate 60 engages the abutment plate 59. The abutment plate 59 is laterally guided in a fixed guide cylinder 62.

The initial stress of the compression spring 52' is selected such that the valve 43 is closed until the fluid pressure at the inlet side 2 rises above the pressure on the outlet side 3 by more than a preselected pressure difference. Preferably the pressure difference is selected as a safety pressure of 0.5 bar.

The size of the diaphragm 38 is such that by action of the pressure acting via the conduit 41 the force caused by the spring 34 and by action of fluid in the space 13 on the diaphragm 30 is overcome as soon as the pressure difference between the pressure at the inlet side 2 and the pressure at the outlet side 3 reaches or falls below, respectively, the mentioned pressure difference, i.e. in particular the preselected safety pressure. At this moment the valve 11 changes over from the first position shown in FIG. 1 into the opposite end position, which results in changing over of the shut-off member 4 from the open position shown in FIG. 1 into the shut-off position.

In operation the tube separator is mounted in a liquid conduit such that the liquid medium will act upon the inlet 2. Assuming that the slide valve 4 is in the open position shown in FIG. 1 which will be the case under conditions to be explained further below, then the medium passes through the connecting channel 5 and flows through the valve 42 via the outlet 3 to the user. At the same time the medium flows via the conduit 12 into the valve chamber 13 and exerts upon the diaphragm 30 a force directed towards the first position of the valve 11. In a direction opposite to this force acts the force exerted by the spring 34 and by the pressure at the second inlet 40 via the diaphragm 38. If the pressure within the connecting conduit 12 forming the first inlet of the control valve 11 exceeds the pressure at the second inlet 40 by a certain amount which is predetermined by the areas of the diaphragms 30, 38 and the initial stress of the spring 34, then the valve 11 is moved into the first position thereof shown in FIG. 1. In this position the inlet pressure acts upon the interior 21 of the cylinder via the cross bores 19, 20, the chamber space 13 and the connecting conduit 12. The initial stress of the spring 61 is selected such that in this valve position the slide valve 4 is in the open position shown in FIG. 1, if the inlet pressure corresponds to a pressure prevailing at the inlet 2 in case that the flow medium has its full pressure at the inlet side. If the pressure prevailing at the inlet 2 falls below a predetermined value, then the valve 11 is moved into the second position by combined action of the spring 34 and the pressure at the second inlet 40. In this second position the first section 14 is separated from the second section 15 by the valve body 26 and the interior 21 of the cylinder is connected with the bore 16, because the valve body 25 is lifted from the valve seat 23. thus the pressure within the interior 21 of the cylinder decreases such that the spring 61 moves the slide valve 4 into the second position thereof, in which the channel 5 is displaced transversely to the inlet and the outlet to such an extent that the slide valve 4 separates the inlet from the outlet by means of the flat side valve gaskets 6, 7. However, the control valve 11 and hence the slide valve 4 are also moved from the first position into the second position, whenever the flow rate from the inlet to the outlet falls below a certain value. With decreasing flow rate also the pressure difference between inlet 2 and outlet 3 decreases. Simultaneously, the force exerted onto the valve 42 by the incident flow decreases such that the spring 52' moves the valve body 45 towards the valve seat 47. In the course of this movement the connection between the second inlet 40 with the outlet 3 via the conduit 41 and the cross bore 52 is released by the valve rod 49 only after the circumferential gasket 46 engages the valve seat 47. At this moment some flow may still occur which is predetermined by the diameter of the bore 48. When the second shut-off valve 44 is opened by the movement of the valve rod 49, the increased pressure on the outlet side acts upon the diaphragm 38 and thus moves the control valve 11 into the second position thereof, whereby the slide valve 4 is moved into its shut-off position in the above described manner. Thus the flow rate will decrease to Zero and the shut-off valve 43 is urged into engagement of the flat gasket 58 with the valve seat 47 by the spring 52', whereby the volume to be expelled thereby may leave via the bore 48 until the total sealing is obtained.

In case the outlet pressure decreases again, for example by opening a tap, then also the pressure at the second inlet 40 of the control valve 11 decreases, because the second shut-off valve 44 is in open position, and the inlet pressure can move the control valve 11 into the first position thereof and hence also the slide valve into the open position in the described manner. The pressure difference hence existing at the first shut-off valve 43 will urge the same off from the valve seat 47 and at the same time close the second shut-off valve 44, if the flow rate exceeds the amount predetermined by the bore 48. In this manner the outlet pressure, which eventually rises again for small flow rates, cannot reach the second inlet 40 and cannot cause the changing back of the tube separator into the shut-off position.

Hence, the described design of the valve 42 effects the shut-off of the tube separator, if there is no flow, without there being a possibility that change-over oscillations may occur for small flow rates and a small pressure difference between inlet 2 and outlet 3 resulting therefrom. In order to also prevent change-over oscillations for slight fluctuations of the inlet pressure the control valve 11 is designed in the manner described above. The operation thereof can be described as follows:

In the first valve position shown in FIG. 1 the medium, from the first inlet 2 of the control valve, exerts on the one hand a pressure onto the diaphragm 30 in a direction opposite to the force exerted by the spring 34 and the diaphragm 38 and on the other hand exerts a force in direction of the force exerted by the spring 34 and the diaphragm 38 by acting upon the valve area 28. Since the area of the diaphragm 30 is substantially larger than the area 28, there is a resultant force in a direction opposite to the force of the spring 34 and the diaphragm 38. If the valve 11 changes over into the second position, then the input fluid again exerts a force in a direction opposite to the force of the spring 34 and the diaphragm 38 by acting upon the diaphragm 30 and furthermore, a force in direction of the force of the spring 34 and the diaphragm 38 by acting upon the area 27. Since the area 27 is larger than the area 28, in the second position the resulting force is smaller than in the first position. This means that a higher inlet pressure is required for changing back the valve from the second position into the first position shown in FIG. 1 than the pressure required for changing over the valve 11 from the first position into the second position. In an analogous manner the resulting force increases after changing over the control valve from the second position into the first position. This means that the forces acting upon the valve after the change-over operation will increase in change-over direction and keep the valve in the changed over position. It is thus achieved that the change-over operation of the control valve 11 and hence of the slide valve 4 for input pressure variations will occur faster and in a more defined manner. It is further achieved that a flutter of the control valve or of the slide valve and thus a not well-defined position of the slide valve is prevented in a critical pressure region causing the changing over of the control valve and the slide valve, respectively, is prevented.

We claim:

1. A tube separator comprising a housing having an inlet side and an outlet side, shut-off means connecting said inlet side with said outlet side in a first position and separating said inlet side from said outlet side in a second position, pilot valve means having a first inlet connected with said inlet side and a second inlet connected with said outlet side and connecting said shut-off means with said inlet side in a first switching position and with a chamber having a pressure which is smaller than a predetermined pressure of the medium at the inlet side in a second switching position as a function of the difference of the pressure at said first and second inlet, and valve means provided between said second inlet and said outlet side for releasing the connection between said second inlet and said outlet side only if the flow pressure of the medium passing through said tube separator in said first position of said shut-off means falls below a predetermined pressure.

2. The tube separator of claim 1, wherein said valve means is designed as a flow monitor.

3. The tube separator of claim 1, wherein said valve means comprises a valve body facing the medium flow and a valve rod. extending therefrom, the valve rod being supported to be slidable in flow direction in a guide bore being connected with the second inlet via a conduit and closing the guide bore in a first position and releasing the same in a second position.

4. The tube separator of claim 3, wherein said valve body comprises a baffle plate.

5. The tube separator of claim 4, wherein said baffle plate is disposed within a channel having a cross section which is smaller at a first location determined by the position of the baffle plate corresponding to the second position of said valve means than at a second location determined by the position of the baffle plate corresponding to the first position of said valve means.

6. The tube separator of claim 5, wherein the cross section of said channel continuously increases from said first location to said second location.

7. The tube separator of claim 1, wherein said pilot valve is designed such that the difference of the pressures at said first and second inlet required for changing over said pilot valve means from said first into said second position is smaller than the pressure difference required for changing over said pilot valve means from said second into said first position.

8. The tube separator of claim 7, said pilot valve means comprising a first and a second valve area, said first valve area being smaller than said second valve area, wherein the fluid pressure of said inlet side may act upon said first area in said first position of said pilot valve means and on said second area in said second position.

9. The tube separator of claim 8, wherein said first and said second area is connected with a first member which is acted upon by the fluid pressure of said inlet side for urging said pilot valve means into said first switching position, and a second member which is acted upon by the fluid pressure at said second inlet for urging said pilot valve means into said second switching position.

10. The tube separator of claim 9, wherein said first and said second member are designed as respective diaphragms.

11. The tube separator of claim 9, comprising means for urging said pilot valve means into said first switching position independent of the fluid pressure at said second inlet.

* * * * *